US006550611B1

(12) United States Patent
Au et al.

(10) Patent No.: US 6,550,611 B1
(45) Date of Patent: Apr. 22, 2003

(54) CONTAINER WITH LOCK DEVICE FOR RING-SHAPED OBJECTS

(75) Inventors: Kinsen Ka Fai Au, Hong Kong (HK); Kin Keung Chiu, Hong Kong (HK)

(73) Assignee: Nationalpak Limited, Tuen Mun (HK)

( * ) Notice: Subject to any disclaimer, the term of this patent is extended or adjusted under 35 U.S.C. 154(b) by 0 days.

(21) Appl. No.: 09/710,727

(22) Filed: Nov. 13, 2000

(51) Int. Cl.[7] ..... B65D 85/40

(52) U.S. Cl. ..... 206/301; 206/18; 206/493; 206/6.1

(58) Field of Search ..... 206/301, 18, 6.1, 206/566, 779, 759, 488, 1.5; 248/116; 211/13.1, 85.2

(56) References Cited

U.S. PATENT DOCUMENTS 3,082,865 A * 3/1963 Nemsky ..... 206/301
3,204,774 A * 9/1965 Barbieri ..... 206/566
4,216,858 A * 8/1980 Beauchamp ..... 206/301
4,300,674 A * 11/1981 Davet ..... 206/566
4,830,181 A * 5/1989 Hartman ..... 206/301
5,579,906 A * 12/1996 Fabbri et al. ..... 206/301
5,873,457 A * 2/1999 Madweb ..... 206/301
6,257,399 B1 * 7/2001 Gursky, Sr. et al. ..... 206/18

* cited by examiner

*Primary Examiner*—Bryon P. Gehman
(74) *Attorney, Agent, or Firm*—Raymond Y. Chan; David and Raymond Patent Group

(57) ABSTRACT

An improved container for watches, jewelry, and other ring-shaped objects designed to include a lock device which prevents the aforementioned objects from being removed from the container. The container comprises of a body with a slot in a face of the body where a ring-shaped object may be inserted. The lock device comprises of a rigid member which may be selectively positioned in a locked position or an unlocked position. The rigid member moves axially in relation to the ring-shaped object when the ring-shaped object is inserted in the slot. In the locked position, the rigid member protrudes into the cavity of the ring-shaped object. In the unlocked position, the rigid member is outside the cavity of the ring-shaped object. The container may further include a mount which releasably attaches to the ring-shaped object. The rigid member of the lock device secures the ring-shaped object inside the slot by pinning down the mount which is attached to the ring-shaped object.

2 Claims, 5 Drawing Sheets

CONTAINER WITH LOCK DEVICE FOR RING-SHAPED OBJECTS

BACKGROUND OF THE PRESENT INVENTION

1. Field of Invention

This invention relates generally to containers for holding and displaying watches, rings, necklaces, or other ring-shaped objects. More particularly, the present invention relates to an improved container for watches, jewelry, and other ring-shaped objects with a lock device which prevents the aforementioned objects from being removed from the container.

2. Description of Related Arts

Traditionally, a watch or an item of jewelry is held and displayed in a jewelry box. The watch or jewelry is inserted into a groove or onto a mount which is contained in the chamber of the jewelry box. A significant problem with the groove or the mount is that the watch or jewelry is frictionally held in the groove or onto the mount. Furthermore, the groove and the mount are also only frictionally held in the chamber of the jewelry box. As a result, the watch or jewelry may easily come out of its box. Any force or vibration can dislodge the watch or jewelry from the box. Furthermore, an individual may easily shoplift the watch or jewelry by exerting a force on the watch or jewelry greater than the frictional force which holds the watch or jewelry in the box.

SUMMARY OF THE PRESENT INVENTION

The present invention concerns a container adapted to securely hold a ringshaped object. The container comprises of a body having a lock device. The lock device can be selectively positioned in an unlocked or a locked position. In the lock position, the lock device securely holds the ring-shaped invention in a slot in a face of the body. One of the advantages of the present invention is that the ring-shaped object cannot be accidentally taken out of its container. The lock device must be positioned in an unlocked position for the ring-shaped-object to be removed. Furthermore, the lock device is inconspicuous and cannot be seen except from a rear view of the container. As a consequence, the lock device does not disturb the aesthetic characteristics of the container. In addition, the lock device is simple to use and simple to manufacture. Further advantages and embodiments of the present invention may be ascertained from the description of the drawings and the description of the preferred embodiment.

DETAILED DESCRIPTION OF THE PREFERRED EMBODIMENT

The container with a lock device of the present invention is designed to securely hold a ring-shaped object. The container can be any shape, size, or color. The container can also be made of any material. However, the preferred material is plastic because of the ease and the low cost of construction.

Figure 1:
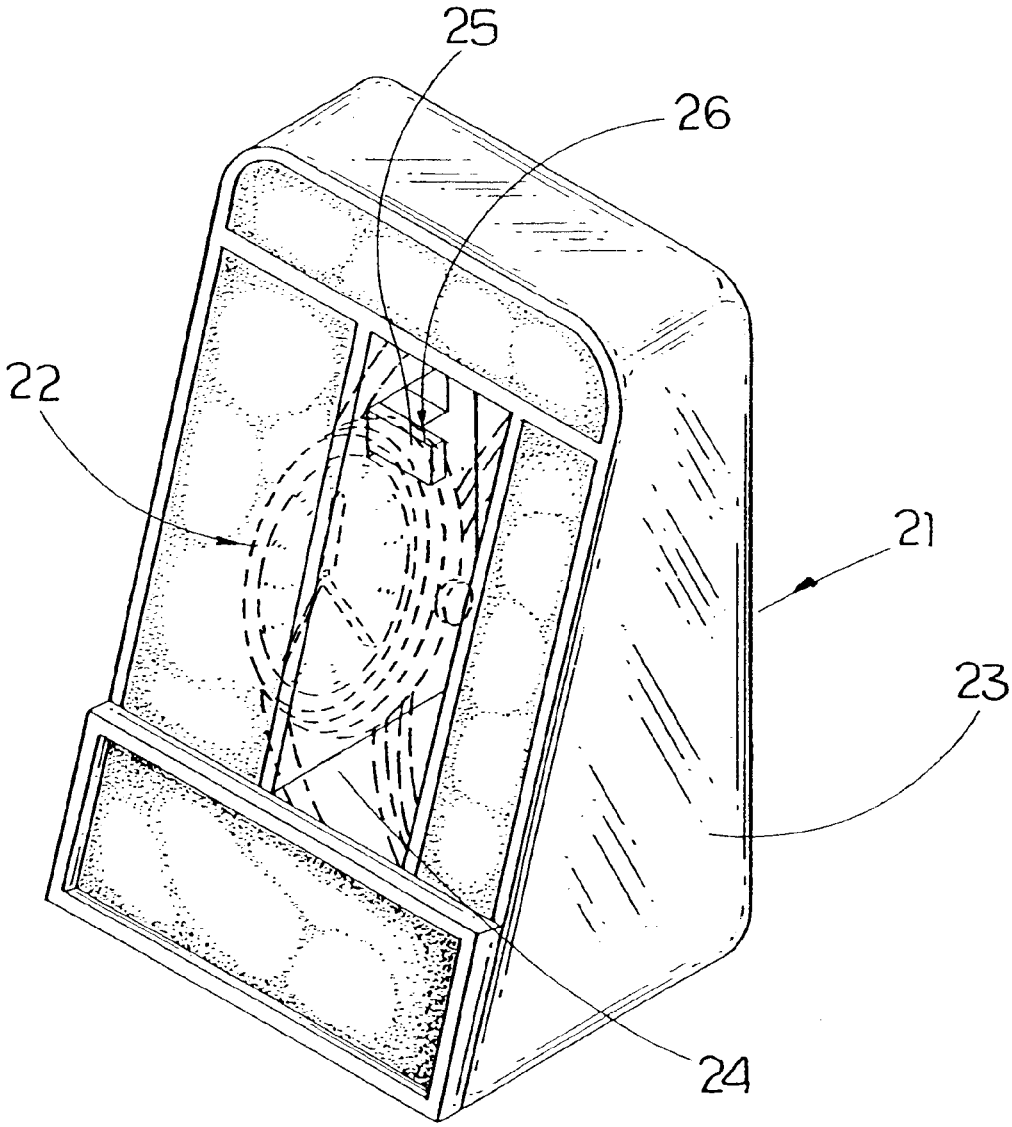
FIG. 1 shows a perspective view of the front side of the present invention with the lock device in a locked position.
Figure 2:
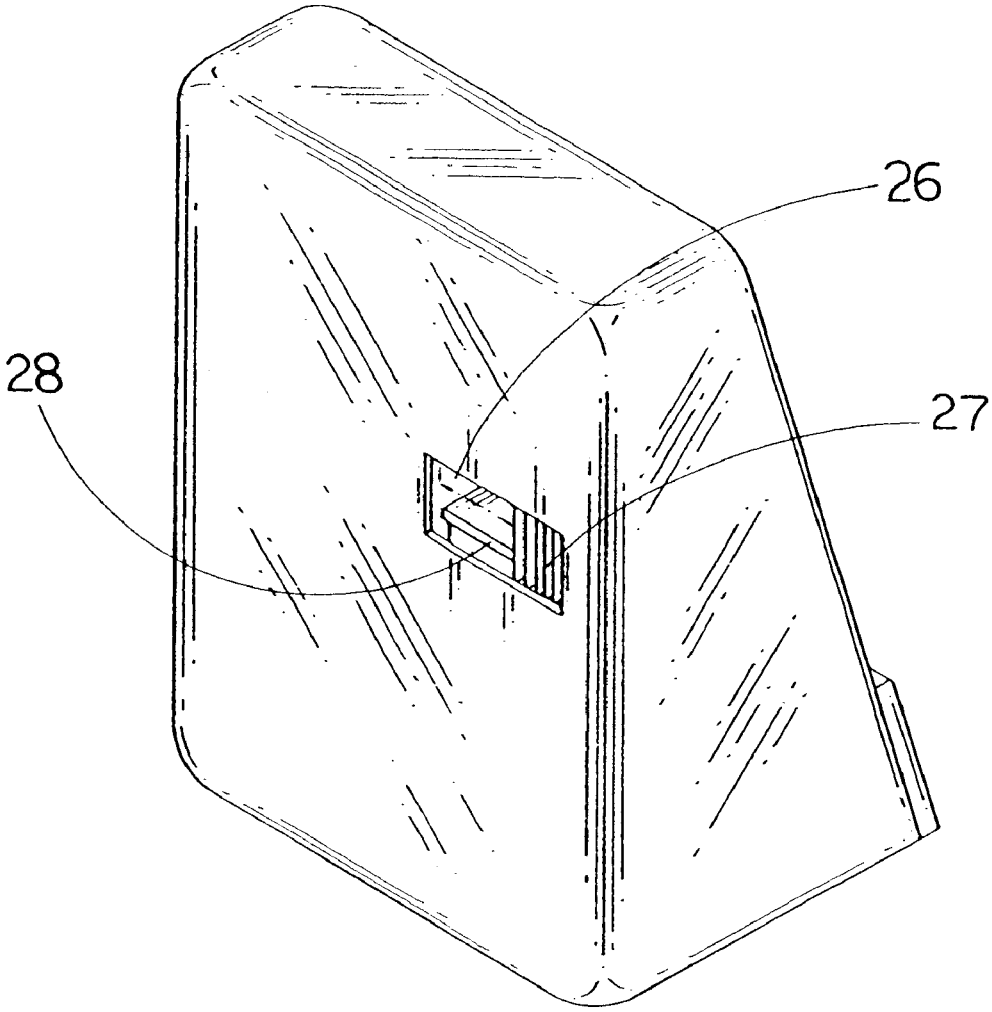
FIG. 2 shows a perspective view of the back side of the container in FIG. 2 with the lock device in an unlocked position.

Referring to the drawings, FIGS. 1 and 2 illustrate the preferred embodiment of a container 21 with a lock device for securely hold a ring-shaped object 22. The container 21, as shown in FIG. 1, is holding a watch, but the container can be adapted to hold any ring-shaped object. The container 21 comprises a body 23 with a slot 24 in one of the faces of the body. The ring-shaped object 22 can be inserted into the slot 24. The lock device can be selectively positioned in a locked position or an unlocked position. Preferably, the lock device comprises a rigid member 25 which in a locked position protrudes into the cavity of the ring-shaped object. An arm 26 actuates the rigid member 25. The arm 26 has a button 27 which extends to the surface of the face opposite the face of the slot 24. The arm 26 slides along brackets 28 formed inside the body 23 of the container 21. FIG. 1 shows the lock device in a locked position. FIG. 2 shows the lock device in an unlocked position.

Figure 3:
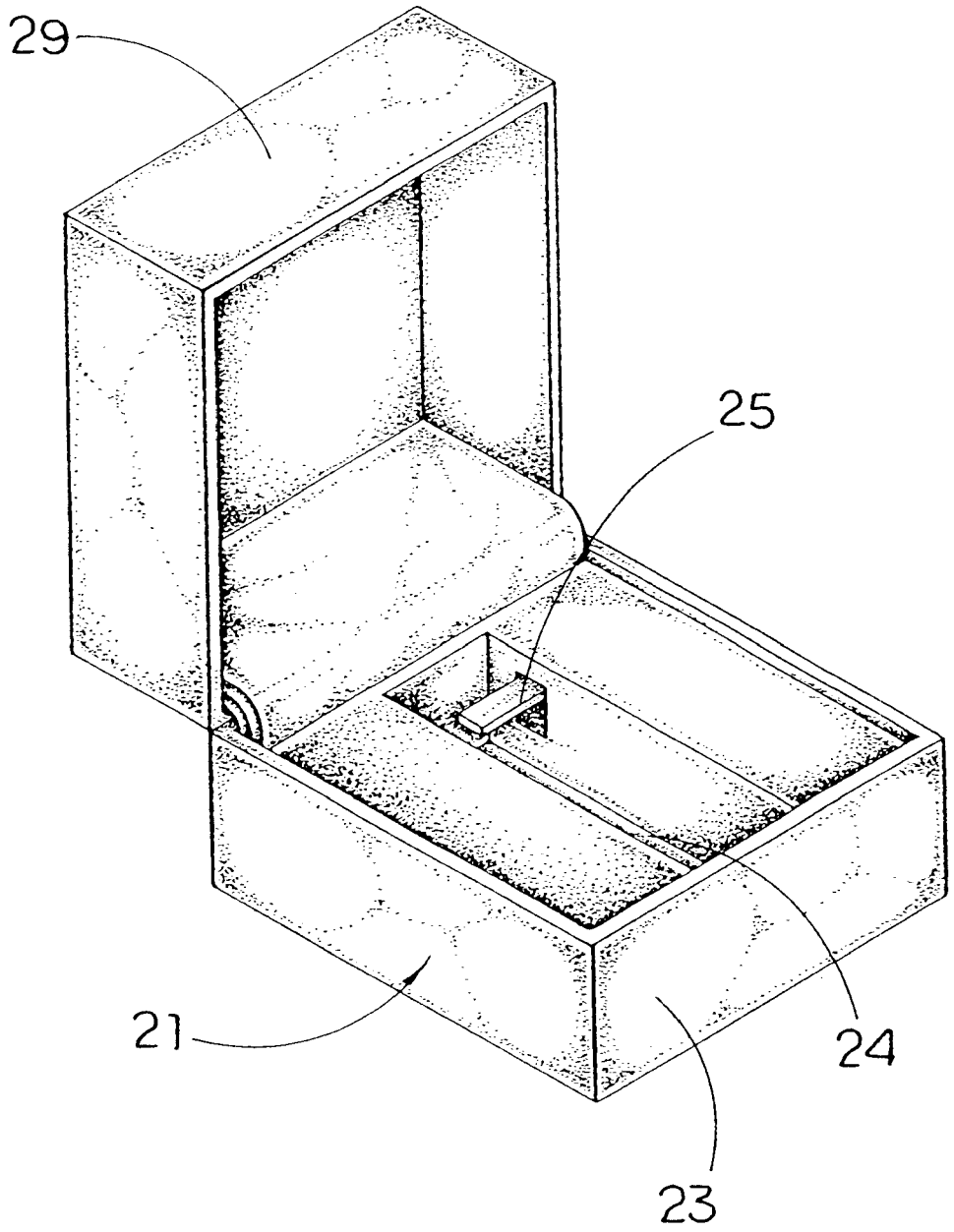
FIG. 3 shows a perspective view of a different embodiment of the container with a cover.
Figure 4:
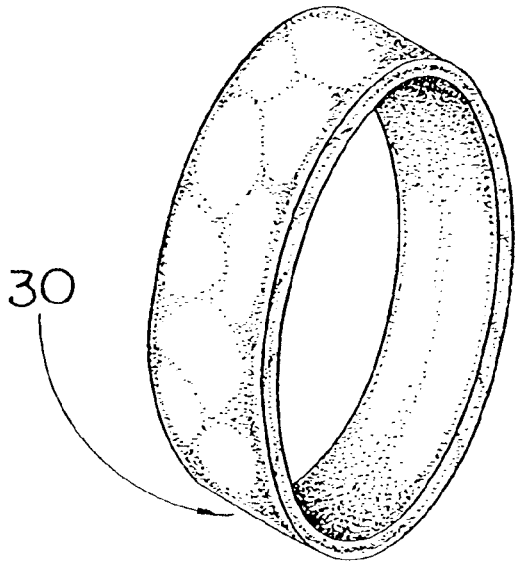
FIG. 4 shows a perspective view of the mount.
Figure 5:
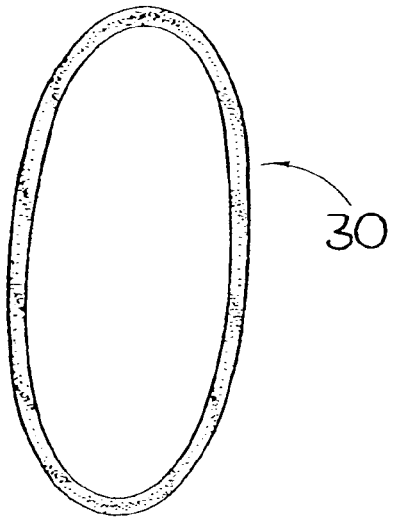
FIG. 5 shows a side view of the mount.
Figure 6:
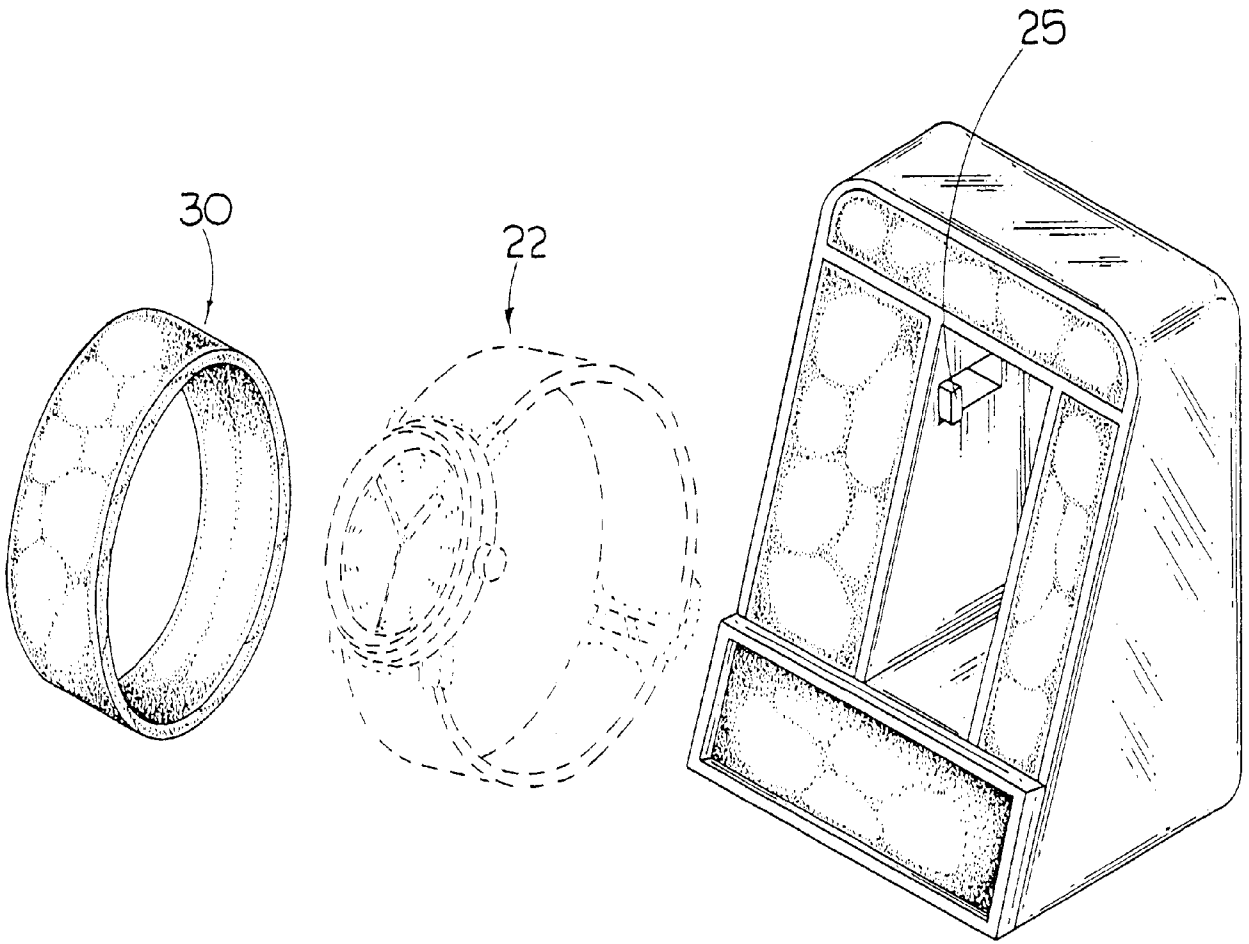
FIG. 6 shows an exploded perspective view of a different embodiment of the container with a mount and with the lock device in an unlocked position.

As shown in FIG. 3, the container can further include a cover 29 which is pivotally connected to the body 23. The container can also be just frictionally connected to the body 23. In the embodiment shown in FIG. 3, the slot 24 is on the top face of the body 23 rather than the front face.

The container can further include a mount. The mount helps to better display the ring-shaped object and to protect the ring-shaped object from damage. In the preferred embodiment, the mount comprises of a looped-band 30. The looped band fits in the inner periphery of the cavity of the ring-shaped object 22. The looped band 30 can be of any stiffness and can be a partial loop. The looped band 30 with the ring-shaped object fitted around it then can be inserted into the slot 24 of the body. The rigid member 25 of the lock device then protrudes into and holds the inner periphery of the looped band 30.

While the foregoing description and figures describe the preferred embodiments of the present invention, it should be appreciated that certain obvious modifications, variations, and substitutions may be made without departing from the spirit and scope of the present invention.

What is claimed is:

1. A container for securely holding a ring-shaped object, comprising:

a body having:
- a front face,
- opposite said front face
- a slot which is indented in said front face and defined between first and second inner side walls for receiving the ring-shaped object in said slot while at least a portion of the ring-shaped object is positioned between said first and second inner sides walls,
- a bracket, which is formed inside said body, communicating with said slot through a wall opening in said first inner side wall and communicating with the outside of the body through a surface opening opened in said rear face; and
- a lock device which comprises:
  - an arm which is disposed in said body to slide along said bracket,
  - a rigid member provided at one end of said arm, and
  - a button which is connected to another end of said arm and movably mounted in said bracket, wherein said button is operable through said surface opening in said rear face of said body so as to operate said rigid member between a lock position and an unlock position;

wherein by moving said button in a direction towards said slot via said surface opening on said rear face of said body, said rigid member is driven by said arm to said lock position that said rigid member is inserted into said slot through said wall opening of said first inner side wall for axially extending through the ring-shaped object for locking the ring-shaped object in position and preventing the ring-shaped object from removing from said slot;

wherein by moving said button in a direction away from said slot via said surface opening on said rear face of said body, said rigid member is driven by said arm to said unlock position that said rigid member is removed from said slot into said bracket through said wall opening for unlocking the ring-shaped object so that the ring-shaped object is capable of being removed from said slot.

2. The container, as recited in claim 1, further comprising a loop shaped mount to be received in said slot for mounting the ring-shaped object therearound so as to fit the ring-shaped object in said slot.

* * * * *